United States Patent [19]

Jenkins et al.

[11] 3,942,776

[45] Mar. 9, 1976

[54] UPHOLSTERY COIL SPRING

[75] Inventors: Harry Lee Jenkins, Hickory; Bobby Dean Wright, Conover, both of N.C.

[73] Assignee: E. R. Carpenter Company, Inc., Richmond, Va.

[22] Filed: Dec. 23, 1974

[21] Appl. No.: 535,743

[52] U.S. Cl. ..... 267/97; 5/256

[51] Int. Cl.[2] ..... F16F 3/04

[58] Field of Search ..... 267/97, 96; 5/256, 260

[56] References Cited

UNITED STATES PATENTS

| | | | |
|---|---|---|---|
| 2,066,861 | 1/1937 | Simmons | 5/256 |
| 3,479,672 | 11/1969 | Haney et al. | 267/97 |

*Primary Examiner*—James B. Marbert

*Attorney, Agent, or Firm*—Beveridge, DeGrandi, Kline & Lunsford

[57] ABSTRACT

A tempered resilient wire forms an upholstery coil spring which has a plurality of interconnected turns, with the top turn being a closed flat loop extending upwardly from the rear of the spring at a given angle to the horizontal, a second turn located immediately below the top turn and being inclined upwardly from the rear of the spring at an inclination angle which is less than the inclination angle of the top turn, a plurality of intermediate turns located below the second turn, and a flat base turn for resting on a support surface.

10 Claims, 4 Drawing Figures

UPHOLSTERY COIL SPRING

This invention relates to upholstery coil springs used for providing a spring edge at the front of an upholstered article of furniture.

Springs of this general type have existed for many years and are formed of a top turn, a plurality of intermediate turns and a base turn which rests on a support surface in the article of furniture. The top turn is affixed to a linear edge wire which extends along the front of the furniture to give the furniture a spring edge.

It has been a practice in the furniture industry to bend the top turn of these coil springs upwardly before installing them in an article of furniture, thus prestressing the springs to maximize the upward force delivered to the edge wire. On occasions, the top turn has been formed of a closed loop with a linear section which lies parallel to the edge wire and is attached thereto by a clip which is conventional in the furniture industry.

When the top turns have been predisposed with an inclination from the horizontal, the top turn has subsequently been deflected downwardly so as to lie in a horizontal plane in the completed article of furniture. Various parts of adjacent turns in the article of furniture are tied together and to the frame, and the springs are held in their compressed positions by means of cords according to a practice well known in the furniture industry.

We have discovered three disadvantages attributable to this prior spring construction and installation technique. First, there is a concentration of torsional stresses in the spring wire at the juncture between the top turn and the second turn which is immediately connected thereto. Second, downward deflection of the top turn also produces a marked downward deflection of the second turn, to an extent that the second turn sometimes is depressed below portions of the third turn, placing the second turn in contact with the cords which are used to compress and position the spring. Third, the second turn is inclined substantially with respect to the turns therebeneath, which prevents the second turn from contributing significantly to the resilience of the spring.

An objective of the present invention is to avoid the previously-mentioned disadvantages of the prior art, providing an upholstery spring which results in a greater distribution of the torsionally stressed zones of the spring wire, prevents the spring wire from contacting the cords when installed in an article of furniture, and enables the second turn to contribute its proportional share to the resilience of the spring.

These advantages are achieved by means of the present invention whereby the second turn, like the top turn, is disposed at an angle which extends upwardly from the rear of the spring. The spring has a top turn in the form of a closed flat loop which extends upwardly from the rear of the spring at a given angle to the horizontal. The second turn is located immediately below the top turn and has a helical form. It, too, is inclined upwardly from the rear of the spring at an angle to the horizontal, but at an angle which is less than the inclination angle of the top turn. Below the second turn are a plurality of intermediate turns and, a base turn which is flat to enable it to rest on a support surface.

For a complete understanding of a preferred embodiment of the invention, the following description will refer to the accompanying drawings wherein FIG. 1 is a perspective view of a spring made according to the invention prior to its installation in an article of furniture.

Figure 1:
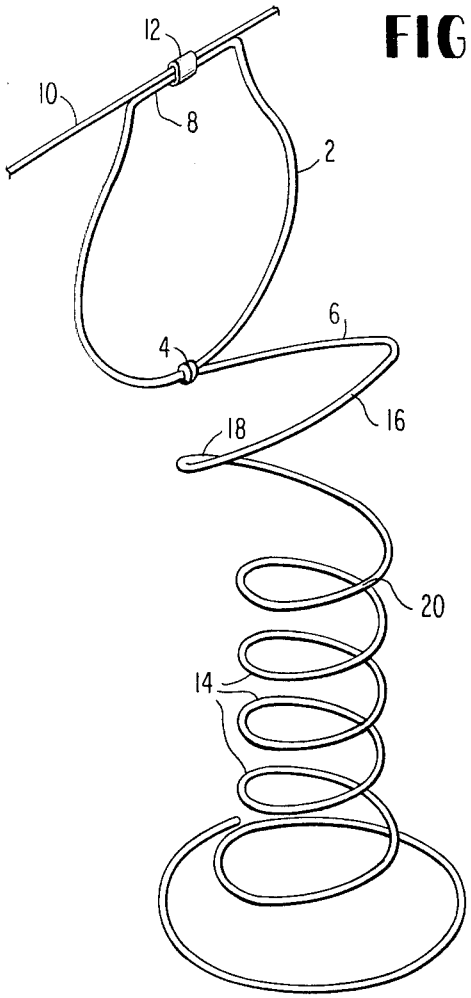

Referring to FIG. 1, it will be seen that the spring has a top turn 2 which is flat and is closed by the knot 4 located at the rear of the spring at the juncture between the top turn 2 and the second turn 6. Diametrically opposed to the knot 4, the top turn 2 is provided with a linear section 8 which, when installed in an article of furniture, will lie parallel to an edge wire and be retained thereto by a clip member. For purposes of illustration, the edge wire 10 and the clip 12 are shown in FIG. 1, with the understanding that these elements will be at the position illustrated in FIG. 3 when installed in an article of furniture.

The inclination angle of the top turn 2, i.e. the angle which it forms with respect to the horizontal, is not critical but in most instances, it will be in the range of about 60° to the illustrated 90°. Since the top turn is horizontally disposed when installed in an article of furniture, it will be recognized that a significant amount of torsional stresses must be sustained by the spring wire as the top turn is drawn from its inclined position down to its horizontal position and the spring compressed as is customary in the art. One purpose of the present invention is to distribute these torsional stresses to as many locations along the spring wire as is feasible, and this is achieved by orienting the second turn which lies immediately below the top turn at an inclination angle which extends upwardly from the rear of the spring.

This inclination angle is measured between a horizontal plane H and a line C which extends from the forwardmost point 16 of the turn to a point 15 located midway between the vertically-spaced rearwardmost points on the turn. Unlike the intermediate turns 14 therebeneath which each have a 180° segment extending downwardly from the rear of the spring and another 180° segment extending upwardly from the rear of the spring, the second turn has its entire helix inclined upwardly from the rear of the spring preferably at an inclination angle which is about 15° to 30°, and/or about one-half the inclination angle of the top turn. This causes the torsional stresses produced by movement of the top turn 2 to its horizontal position to be distributed in the area of the knot 4, at the intermediate or forwardmost point 16 of the second turn, at the juncture 18 between the second turn and the third turn and at the intermediate or forwardmost point 20 of the third turn.

Figure 3:
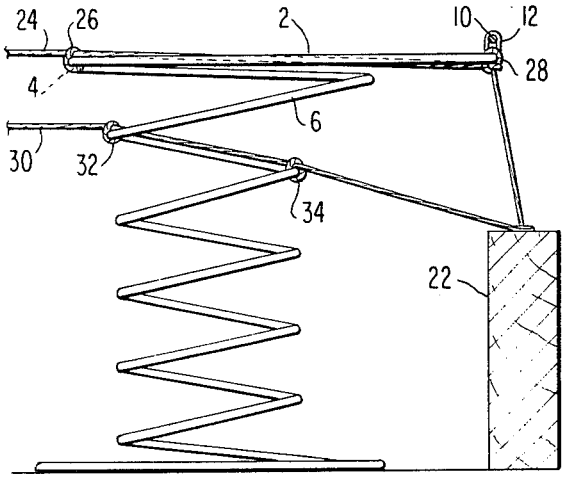
FIG. 3 illustrates the spring of FIGS. 1 and 2 in its compressed condition, showing the top turn at its desired horizontal orientation and the various cords used to retain the spring in position; and, FIG. 4 shows a spring according to the prior art when placed within an article of furniture, illustrating the undesirable contact between the spring and the spring-retaining cords.

A second advantage attributable to the upward inclination of the second turn is that it avoids any contact between the second turn and the conventional tie cords which are used in furniture manufacture. This aspect of the invention is illustrated in FIG. 3 where the spring is shown tied to a furniture frame. These frames conventionally are rectangular frames which include a wooden front piece 22. Webbing is attached to the bottom of these frames and the upholstery springs are usually affixed to this webbing by means of hog ring fasteners or other connecting means.

In upholstered funiture, a number of cords are used to tie the springs in position, only some of these cords being shown in this application. One such cord 24 is tied at 26 to the area of the knot 4 of the top turn. The cord 24 extends horizontally from the knot 26 to a knot 28 where it engages the linear section 8 of the top turn 2. From the knot 28, the cord extends downwardly to a point where it is affixed to the upper surface of the wooden element 22 by means of a nail or other fastener. A lower cord 30 is also used, being tied in a knot at 32 which is located at the juncture of the second and third turns and at 34 which is the intermediate point of the third turn.

It is readily seen in FIG. 3 that the second turn is parallel to the intermediate turns 14, rather than being inclined as was the case in the prior springs described below. This enables the second turn to contribute to the resilience of the spring. The cords 24 and 30 do not contact any portion of the spring, except at the points where the knots are intentionally formed. Thus, there is no frictional or abrasive contact between the cords and the springs, subject to producing wear in the cords as the springs are compressed and released during normal usage of the furniture.

Figure 4:
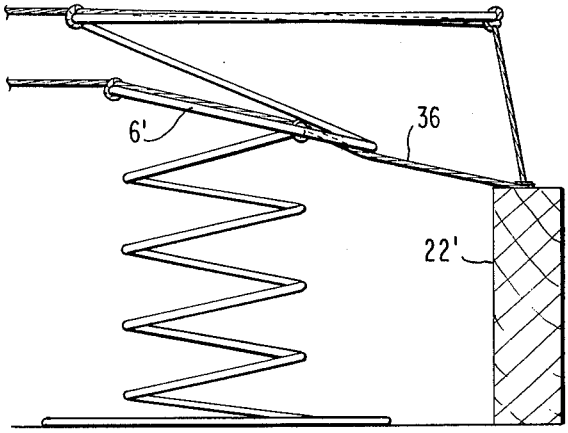
FIG. 4 (PRIOR ART)

FIG. 4 shows a spring construction according to the prior art where the second coil is not predisposed at an upward inclination. There, it will be seen that the second turn 6' is inclined with respect to the turns therebeneath, thus detracting from its ability to contribute its respective share to the resilience of the spring. This turn 6', at its forwardmost point, is disposed below the forwardmost point on the third turn. With this disposition, the spring is in contact with the cord segment 36 which extends from the forward edge of the third turn to the wooden frame element 22'. As the spring is compressed under normal use, the second turn will bear upon the cord segment 36 and tend to produce undesired wear therein. As previously-explained, this disadvantage is avoided by the present invention.

Figure 2:
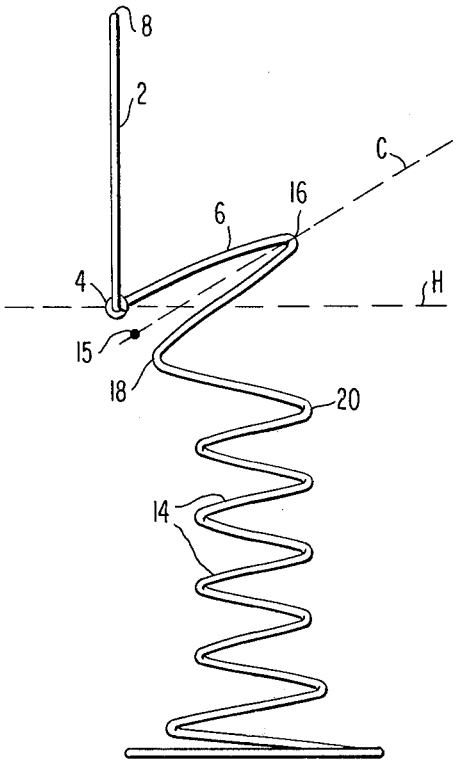
FIG. 2 is a side elevation of a spring constructed according to the invention prior to its installation in an article of furniture.

Springs according to the invention may be cold formed in a conventional spring forming machine and, after being in the shape illustrated in FIGS. 1 and 2, are stress-relieved at a temperature of about 512° to 600°F. The springs are air cooled, thus leaving them in a stiff resilient condition whereby their elastic memory will sustain the normal forces encountered in furniture construction.

Those skilled in this art will realize that there are modifications and improvements which may be made to the single disclosed embodiment of the invention. Further the springs may be placed at various orientations and at different locations in the article of furniture, so the reference to the front and rear of the spring and the use of a horizontal reference plane are for purposes of describing the spring construction rather than being a limitation as to its final disposition. It is emphasized that the invention is not limited solely to the embodiment disclosed herein, but encompasses variations, modifications and improvements which fall within the spirit of the claims which follow.

We claim:

1. An upholstery coil spring comprising a tempered resilient wire forming a plurality of interconnected turns including a top turn, a plurality of intermediate turns and a bottom turn, said top turn extending upwardly from the rear of the spring at a given angle to the horizontal, a second turn located immediately below the top turn and having a helical form, said second turn being inclined upwardly from the rear of the spring at an angle which is less than said given angle of the top turn, said intermediate turns being located below the second turn, and said base turn being a flat turn for resting on a support surface.

2. The upholstery coil spring of claim 1 having an edge wire connected to the front of the top turn, and means for drawing the top turns down from its inclined position to a horizontal position.

3. The upholstery coil spring of claim 1 wherein the angle of the second turn is about one-half the given angle of the top turn.

4. The upholstery coil spring of claim 3 where the given angle of the top turn is about 60° to 90°.

5. The upholstery coil spring of claim 4 wherein the top turn is a closed flat loop provided with a linear section at its uppermost portion.

6. The upholstery coil spring of claim 1 wherein the given angle of the top turn is about 60° to 90°.

7. The upholstery coil spring of claim 6 wherein the top turn is a closed flat loop provided with a linear section at its uppermost portion.

8. The upholstery coil spring of claim 7 having an edge wire connected to the front of the top turn, and means for drawing the top turn down from its inclined position to a horizontal position.

9. The upholstery coil spring of claim 1 wherein the angle of the second turn is about 15° to 60°.

10. The upholstery coil spring of 9 wherein the given angle of the top turn is about 60° to 90°.

* * * * *